US006855010B1

(12) United States Patent
Yen

(10) Patent No.: US 6,855,010 B1
(45) Date of Patent: Feb. 15, 2005

(54) TERMINAL FOR ELECTRIC CONNECTOR FOR COMMUNICATION APPARATUS

(75) Inventor: Wu Bin Yen, Taipei Hsien (TW)

(73) Assignee: Chuan Yi Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 10/763,195

(22) Filed: Jan. 26, 2004

(51) Int. Cl.[7] ..... H01R 13/24
(52) U.S. Cl. ..... 439/700
(58) Field of Search ..... 439/862, 700, 439/824, 219, 65–67; 324/761, 754

(56) References Cited

U.S. PATENT DOCUMENTS 6,524,140 B2 * 2/2003 Takagi et al. ..... 439/700
6,783,405 B1 * 8/2004 Yen ..... 439/824
6,784,680 B2 * 8/2004 Haga et al. ..... 439/700

* cited by examiner

*Primary Examiner*—Tho D. Ta
*Assistant Examiner*—Felix O. Figueroa
(74) *Attorney, Agent, or Firm*—Rosenberg, Klein & Lee

(57) ABSTRACT

A terminal stamped from a phosphor bronze sheet member for electric connector for communication apparatus is disclosed to have a plurality of I-shaped spring wire portions connected in series between a protruding contact portion and a mounting plate portion.

1 Claim, 4 Drawing Sheets

TERMINAL FOR ELECTRIC CONNECTOR FOR COMMUNICATION APPARATUS

BACKGROUND OF THE INVENTION

1. Field of the Invention

The present invention relates to a terminal for electric connector for communication and, more particularly, to such a terminal that easily positively be positioned in the connector housing for signal transmission without producing much impedance.

2. Description of the Related Art

Communication apparatus are important implement for communication among people at distance. Advanced communication apparatus commonly have a small size with high transmission power. For a compact communication apparatus, the component parts and terminals must be made relatively smaller. FIG. 1 shows a terminal for electric connector for communication apparatus according to the prior art. According to this design, the terminal, referenced by 100, is stamped from a metal sheet member, comprising a protruding contact portion 102 disposed at one end, a mounting plate portion 10 disposed at the other end, a spring coil portion 101 connected between the protruding contact portion 102 and the mounting plate portion 10, a bonding tip 10*b* extended from the bottom side of the mounting plate portion 10 for soldering to a circuit board, and two hooks 10*a* protruding from two opposite lateral sides of the mounting plate portion 10. During installation, the terminal 100 is inserted into the receiving chamber 21 of an electrically insulative housing 20 for electric connector to force the hooks 10*a* into engagement with the inside wall of the housing 20 (see FIG. 1A). When installed, the protruding contact portion 102 extends out of the front opening of the housing 20 for contact. This design of terminal 100 for electric connector is still not satisfactory in function. Due to weak structural strength, the terminal 100 tends to be permanently deformed or damaged during installation of the electric connector (see FIG. 1B).

FIG. 2 shows another structure of terminal for electric connector according to the prior art. This design of terminal is similar to that shown in FIG. 1 with the exception of the two additional parallel side guide strips 103 that are bilaterally extended from the top side of the mounting plate portion 10 in direction reversed to the bonding tip 10*b* and spaced from the spring coil portion 101 at two sides. This structure of terminal is still not satisfactory in function because the protruding contact portion 102 tends to be biased, affecting signal transmission quality. Further, in order to reduce impedance produced during signal transmission, beryllium copper is used for making the terminal. However, a terminal of beryllium copper is relatively expensive.

In order to eliminate the aforesaid drawbacks, the inventor invented an improved structure of terminal. This design of terminal 300 comprises a protruding contact portion 35 disposed at one end, a mounting plate portion 30 disposed at the other end, two spring coil portions 34 symmetrically bilaterally connected between the protruding contact portion 35 and the mounting plate portion 30, a bonding tip 31 extended from the bottom side of the mounting plate portion 30 for soldering to a circuit board, two hooks 33 protruding from two opposite lateral sides of the mounting plate portion 30, and two springy retaining strips 32 protruded from the mounting plate portion 30 and spaced between the hooks 33. As shown in FIG. 4, the terminal 300 is inserted into the receiving chamber 21 of an electrically insulative housing 20 for electric connector to force the springy retaining strips 32 and the hooks 33 into engagement with the inside wall of the housing 20. When installed, the protruding contact portion 35 extends out of the front side of the housing 20, and the two spring coil portions 34 keep the protruding contact portion 35 in balance. Therefore, the use of the electric connector does not cause the protruding contact portion 35 to bias. Further, the terminal 300 is directly stamped from a phosphor bronze sheet member for the advantages of low impedance and low cost.

SUMMARY OF THE INVENTION

The present invention has been accomplished under the circumstances in view. It is the main object of the present invention to provide a terminal for electric connector for communication apparatus, which is durable in use. It is another object of the present invention to provide a terminal for electric connector for communication apparatus, which has low impedance. It is another object of the present invention to provide a terminal for electric connector for communication apparatus, which is inexpensive to manufacture. To achieve these and other objects of the present invention, the terminal is directly stamped from a phosphor bronze sheet member, having protruding contact portion disposed at one end, a mounting plate portion disposed at the other end, and two spring wire portions connected in series between the protruding contact portion and the mounting plate portion.

DETAILED DESCRIPTION OF THE PREFERRED EMBODIMENT

Figure 5:
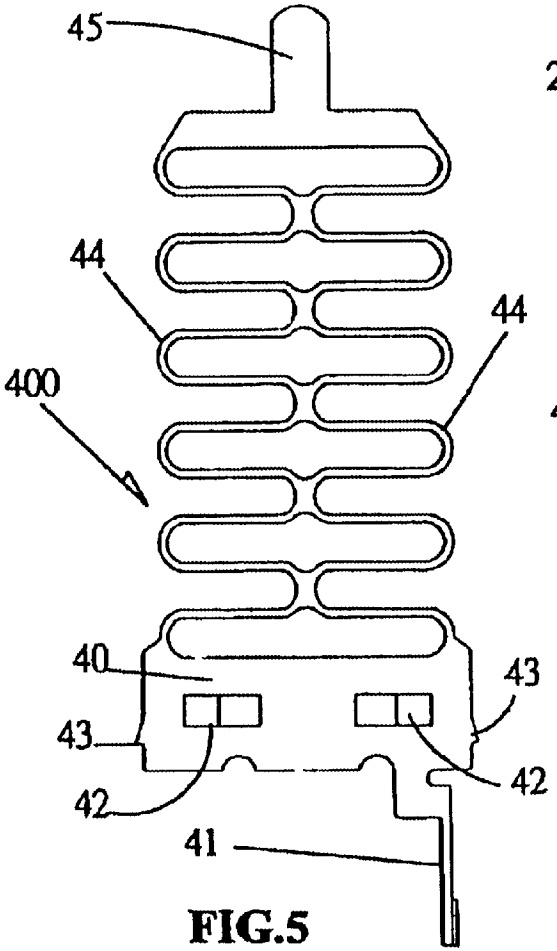
FIG. 5 is a plain view of a terminal for electric connector for communication apparatus according to the present invention.

Referring to FIG. 5, a terminal 400 for electric connector for communication apparatus in accordance with the present invention is shown comprising a protruding contact portion 45 disposed at one end, a mounting plate portion 40 disposed at the other end, a plurality of substantially I-shaped spring wire portions 44 connected in series between the protruding contact portion 45 and the mounting plate portion 40, a bonding tip 41 extended from the bottom side of the mounting plate portion 40 for soldering to a circuit board, two hooks 43 protruding from two opposite lateral sides of the mounting plate portion 40, and two springy retaining strips 42 protruded from the mounting plate portion 40 and spaced between the hooks 43.

Figure 1B:
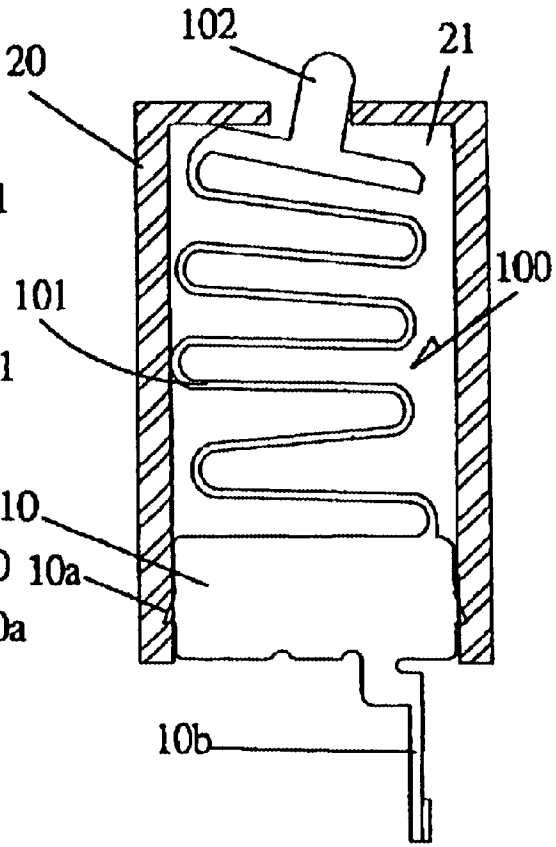
FIG.1B PRIOR ART
FIG. 1B is similar to FIG. 1A but showing the protruding contact portion biased.
Figure 1A:
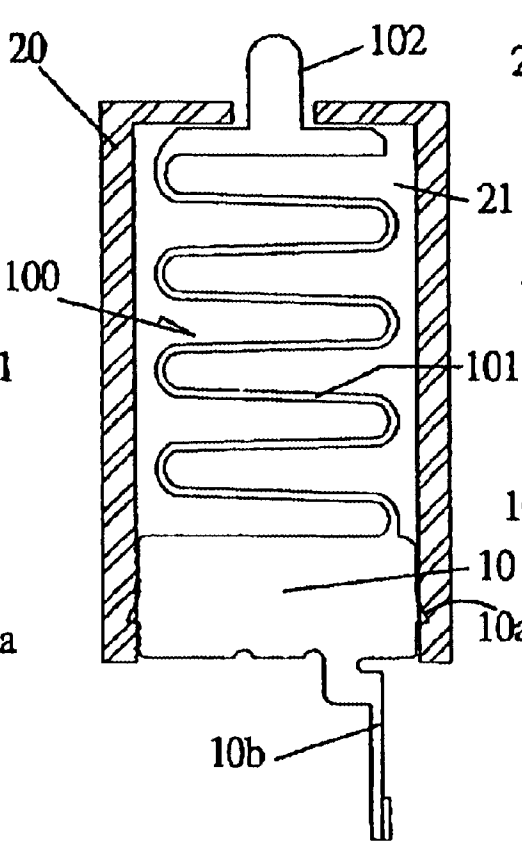
FIG.1A PRIOR ART
FIG. 1A illustrates the terminal of FIG. 1 installed in an electrically insulative housing.
Figure 1:
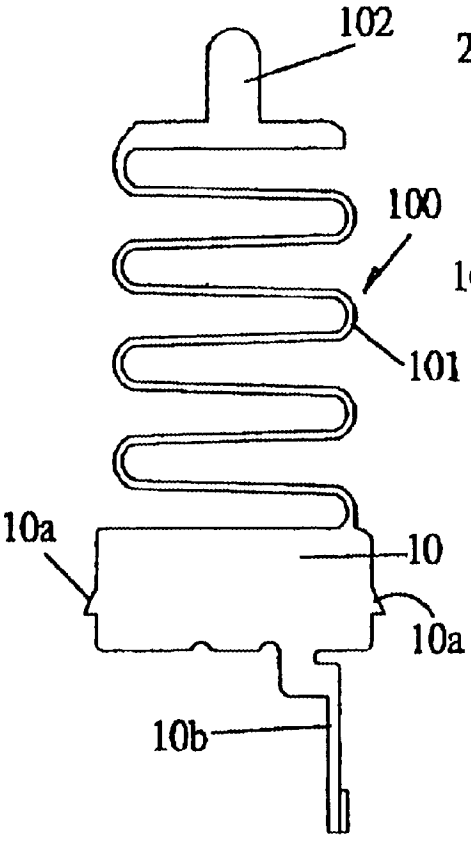
FIG.1 PRIOR ART
FIG. 1 is a plain view of a terminal for electric connector for communication apparatus according to the prior art.
Figures 2, 2A, 2B:
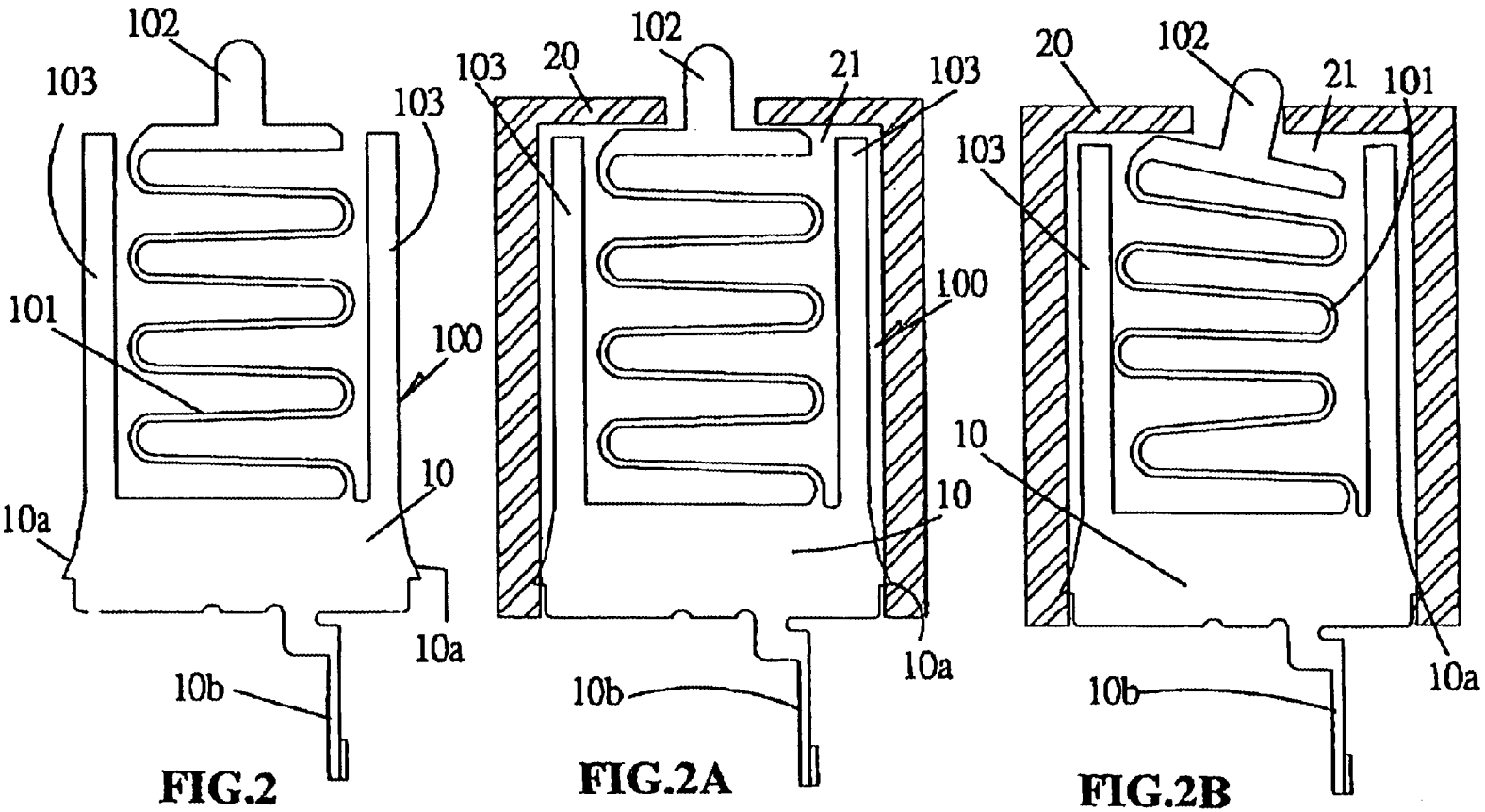
FIG.2 PRIOR ART
FIG.2A PRIOR ART
FIG.2B PRIOR ART
FIG. 2 is a plain view of another structure of terminal for electric connector for communication apparatus according to the prior art.
FIG. 2A illustrates the terminal of FIG. 2 installed in an electrically insulative housing.
FIG. 2B is similar to FIG. 2A but showing the protruding contact portion biased.
Figure 4:
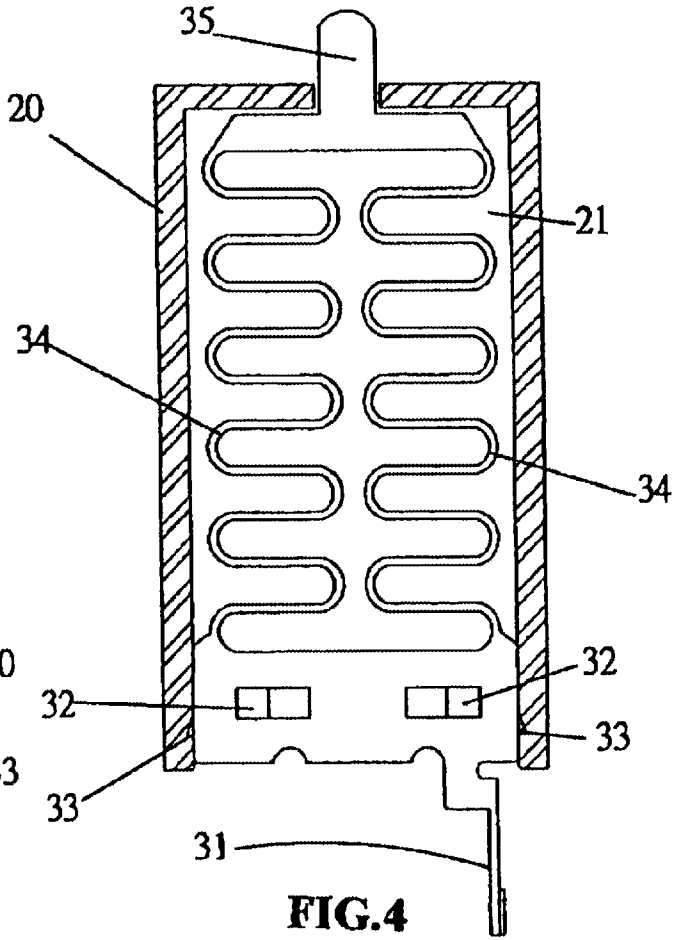
FIG.4 PRIOR ART
FIG. 4 illustrates the terminal of FIG. 3 installed in an electrically insulative housing.
Figure 3:
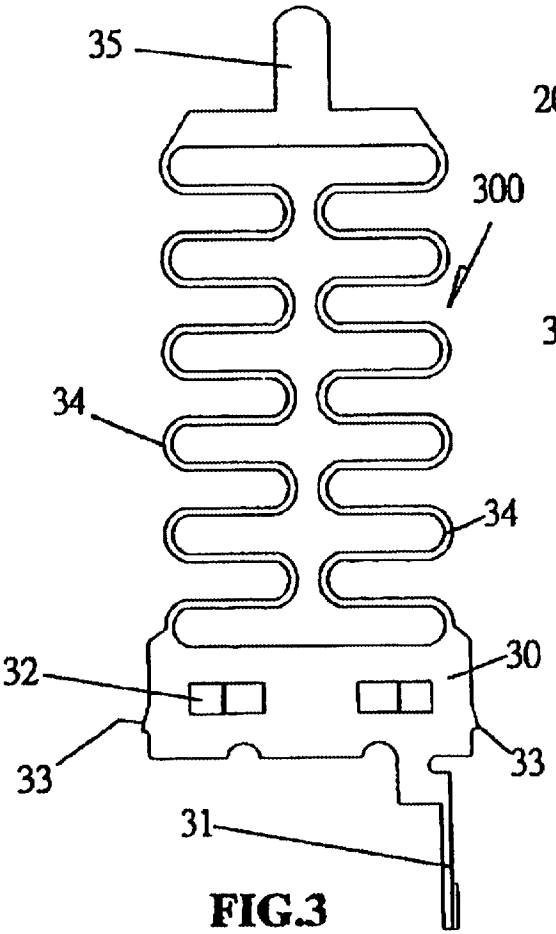
FIG.3 PRIOR ART
FIG. 3 is a plain view of still another structure of terminal for electric connector for communication apparatus according to the prior art.
Figure 6:
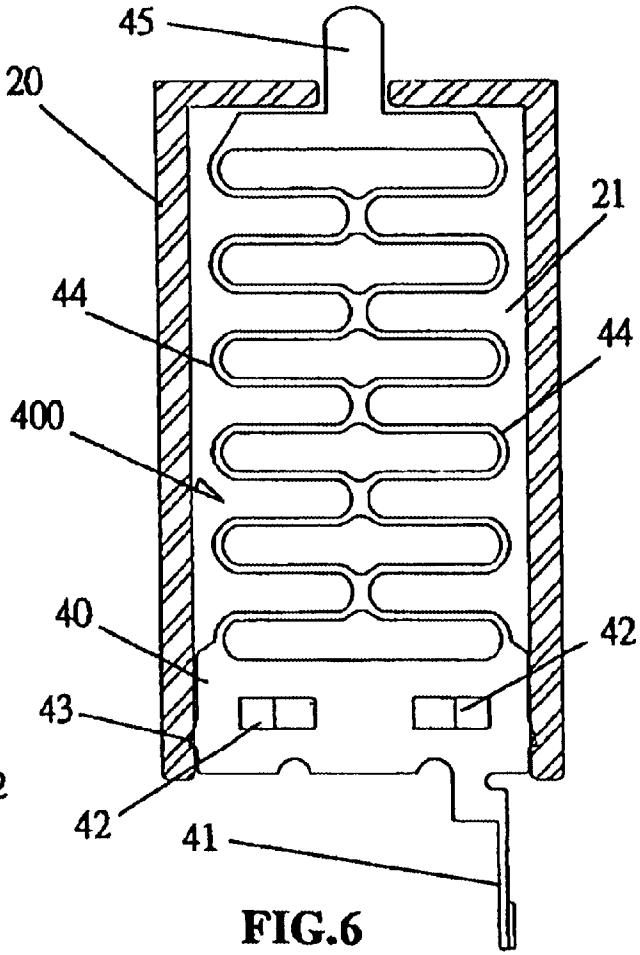
FIG. 6 illustrates the terminal installed in an electrically insulative housing according to the present invention.

Referring to FIG. 6, the terminal 400 is inserted into the receiving chamber 21 of an electrically insulative housing 20 for electric connector to force the springy retaining strips 42 and the hooks 43 into engagement with the inside wall of the housing 20. When installed, the protruding contact portion 45 extends out of the front side of the housing 20, and the I-shaped spring wire portions 44 support the protruding contact portion 45 in balance. Therefore, the use of the electric connector does not cause the protruding contact portion 45 to bias or to deform. Further, the terminal 400 is directly stamped from a phosphor bronze sheet member for the advantages of low impedance and low cost.

A prototype of terminal for electric connector has been constructed with the features of FIGS. 5 and 6. The terminal for electric connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A terminal comprising a protruding contact portion disposed at a first end thereof, a mounting plate portion disposed at a second end thereof, a plurality of I-shaped spring wire portions connected in series between said protruding contact portion and said mounting plate portion, a bonding tip extended from a bottom side of said mounting plate portion for soldering to a circuit board, two hooks protruding from two opposite lateral sides of said mounting plate portion for positioning, and two springy retaining strips protruded from said mounting plate portion and spaced between said hooks for positioning.

* * * * *